US005113560A

United States Patent [19]

Bird

[11] Patent Number: 5,113,560

[45] Date of Patent: May 19, 1992

[54] PROCESS OF PRODUCING CACTUS JEWELRY

[75] Inventor: Terry A. Bird, R.F.D. 1, Box 1183, Payson, Utah 84651

[73] Assignee: Terry Anthony Bird, Payson, Utah

[21] Appl. No.: 533,099

[22] Filed: Jun. 4, 1990

Related U.S. Application Data

[63] Continuation of Ser. No. 251,301, Sep. 30, 1988, abandoned.

[51] Int. Cl.[5] ..... B21F 43/00; B23P 13/00

[52] U.S. Cl. ..... 29/160.6; 29/412; 29/527.6; 63/2; 63/DIG. 3

[58] Field of Search ..... 29/160.6, 412, 417, 29/527.6; 63/1.1, 2, DIG. 3; 427/4; 428/13, 14, 27

[56] References Cited

U.S. PATENT DOCUMENTS

| | | | |
|---|---|---|---|
| 3,700,533 | 10/1972 | Schmitz | 264/162 |
| 3,905,172 | 9/1975 | Blackburn | 264/158 |
| 3,997,686 | 12/1976 | McClure | 427/4 |
| 4,686,251 | 8/1987 | Ostermann et al. | 264/122 |

FOREIGN PATENT DOCUMENTS

| | | | |
|---|---|---|---|
| 2450223 | 5/1976 | Fed. Rep. of Germany | 63/2 |
| 3112351 | 11/1982 | Fed. Rep. of Germany | 63/2 |
| 2569958 | 3/1986 | France | 29/160.6 |

*Primary Examiner*—P. W. Echols
*Attorney, Agent, or Firm*—George Mortimer

[57] ABSTRACT

The process comprises cutting suitable lengths of wood from the trunk and stems of dead plants of the Chola Cactus which have bark surrounding the lengths and pith in the hollows thereof. The bark and pith are removed from the lengths to leave clean wood. The lengths of clean wood are encapsulated with metal or plastic chosen from the group of metals consisting of silver, copper, brass and the like and from thermosetting and thermoplastic plastics by placing the lengths of wood in a mold somewhat larger in diameter than the pieces of wood to be encapsulated so as to provide a layer of the encapsulating material surrounding the length of wood. Disks about ⅛ inch thick may be cut transversely from the encapsulated lengths of wood to form jewelry items. Matched earrings may be produced by cutting two disks along a common transverse plane, securing means to the opposite sides of the disks for fastening them to the lobe of a person's ear. Another embodiment of this process comprises removing wood from the center of a length of the wood so as to form a cylinder which may have an internal diameter suitable for a finger ring or for an arm bracelet when transverse lengths are cut therefrom. The wood in this embodiment may be encapsulated before or after being cut from the length of wood. The mold used for encapsulating cylinders must have a core tube spaced from the outer tube far enough to provide space for covering the inner and outer surfaces of the cylinder of wood as well as to encapsulate it.

9 Claims, 1 Drawing Sheet

2
8
13

3
12
14
3

15
4
3
3
5

3
5
12
3

13
3
7
6
5

10
11
9

PROCESS OF PRODUCING CACTUS JEWELRY

This application is a continuation of Ser. No. 251,301, filed Sep. 30, 1988, now abandoned.

The present invention relates to the process of producing cactus jewelry, by which is meant jewelry in which a length of a trunk or stem of the Chola Cactus which has been freed of bark and material other than the wood thereof (pith), is encapsulated in a mold with metal, such as silver, brass, copper, and the like, or with resins, such as those which polymerize at ambient temperature or which are thermoplastic. These encapsulated pieces are then cut transversely into relatively thin disks, e.g., about ⅛ thick, which may be smoothed and/or polished, e.g., with very fine sandpaper, and optionally stained and/or coated with lacquer and the like to give the disks a polished appearance. The wood may remain in the jewelry disks or be removed, if desired, leaving a disk with holes in it where the wood had been.

BACKGROUND OF THE INVENTION

Inlaid plastic articles have been proposed for various non-jewelry purposes. Among these prior proposals are inlaid tags in the Murray U.S. Patent No. 2,586,978, granted Feb. 26, 1952, decorative panels in the Schmitz U.S. Pat. No. 3,700,533, granted Oct. 24, 1973, wooden floor panels in Blackburn U.S. Pat. No. 3,905,172, granted Sep. 16, 1975, and decorative trays in Ostermann U.S. Pat. No. 4,686,251, granted Aug. 11, 1987. These proposals are remote from the present invention and would not lead an ordinary skilled worker to the product of the present invention.

SUMMARY OF THE INVENTION

The process of the present invention comprises encapsulating suitable lengths of the trunk and/or stems of chola cactus with metal, such as silver, copper, brass, and the like, or plastic, such as thermoplastic or thermal setting material, and cutting thin (e.g., about ⅛ inch) disks transversely therefrom. The disks may be used as earrings, necklaces, pendants, hair clips, key rings, tie tacks, and the like. Earrings may be made from a pair of disks having identical but unique designs on one face which have been cut from one position on a length of the wood, e.g., earrings, having the ear clip secured to the opposed faces so that the identical faces are displayed when the earrings are attached to a person's ears.

BRIEF DESCRIPTION OF THE DRAWINGS

The invention will be described and illustrated by reference to the drawings in which.

DETAILED DESCRIPTION OF PREFERRED EMBODIMENTS OF THE INVENTION

Figures 1, 2, 3, 4, 5, 6:
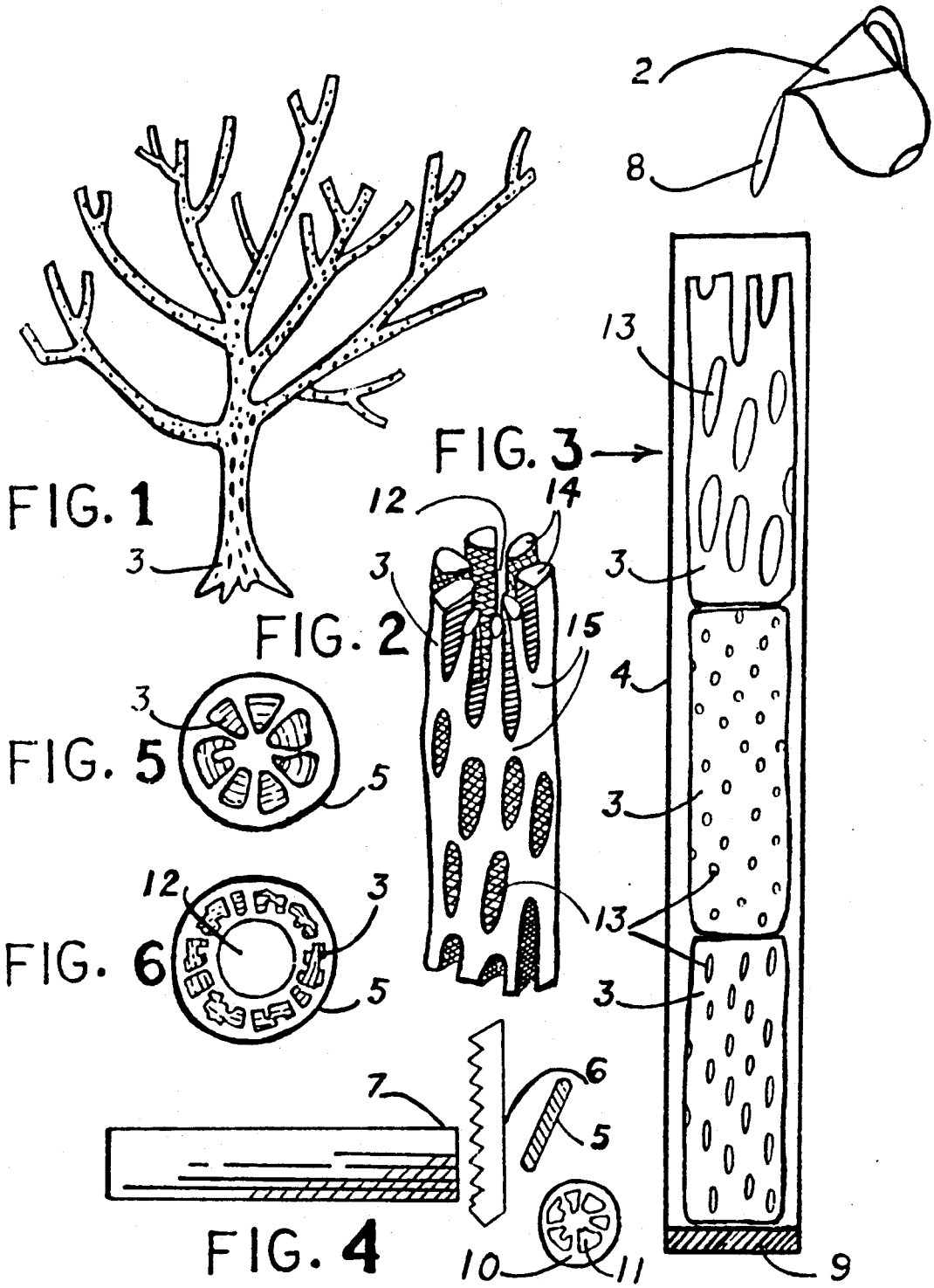
FIG. 1 represents a dead cactus bush of the chola family.
FIG. 2 is a length of stem of such a bush suitable for encapsulation.
FIG. 3 is a vertical sectional view of a mold closed at the bottom end and open at the top in which three lengths of the stems of the cactus plant are housed and a moldable material is being poured into the mold to encapsulate the pieces of stems.
FIG. 4 illustrates how cactus wood that has been encapsulated can have discs cut transversely from it.
FIG. 5 is a finished disc that has been cut from a section of cactus that has been encapsulated, with the wood remaining in the disc.
FIG. 6 is a disc with a void in the center, that was cast with a two piece mold, with the center mold being used to keep the encapsulating material from filling the center.

The process of the invention comprises preparing wood from the dead trunk and/or stems of the chola cactus plants from which bark and other material (pith) have been removed from the wood. The pieces of trunk and stem, when cut to suitable length and have bark, pith and the like removed, are clean wood (3) ready for encapsulation which may be done by placing one or more lengths of the prepared wood in a mold, pouring liquid encapsulating material such as metal and plastics into the mold to fill all the voids in the wood and permitting the material to set. Each encapsulated length is removed from the mold, disks are cut transversely therefrom and finished to make the desired article.

Each length of cactus wood is unique. No two lengths are ever the same. Moreover, no two disks cuts from an encapsulated length of the wood are the same although the two adjacent faces of two disks formed by the same cut are almost identical. This peculiarity of the disks of the invention can be of special interest and value in making jewelry from the disks. For example, by using the identical faces as the faces to be seen in earrings, i.e., by putting the pins or clasps on the opposite surfaces, matched but unique earrings for the two ears are achieved.

Referring now to FIG. 1 of the drawing which represents a dead plant typical of the chola cactus family comprising a trunk and branches but no roots. The roots do not have the desired structure and for this reason are not shown in the drawing. The trunk and branches include wood of the type illustrated in FIG. 2 which comprises longitudinal segments 14 of the circular branch or stem which are joined at 15 for short distances to adjacent segments on their lateral surfaces, which leaves voids 13 between the joined parts. As cut from a dead plant, the section of wood is covered by bark and pith fills the voids. The pith and bark must be removed in any suitable way to prepare the wood for the encapsulation operation, as seen in FIG. 2.

Referring now to FIG. 3, the encapsulation operation comprises placing one or more lengths, three lengths being illustrated, in a suitable mold 14, preferably of cylindrical configuration, having an internal diameter somewhat larger than the outside diameter of the pieces of cactus wood to be encapsulated in the mold. Casting 7 is removed from mold 4. Disc 5 is cut from casting 7. Disc 10 has voids 11 where the wood has been removed. It may be filled with a contrasting material such as stone, plastic or glass. The mold is closed at the bottom by a plug 9. It may be made of any suitable metal or plastic material from which the encapsulated lengths may be removed, or, if desired, the mold may become part of the article. The bottom length of wood is properly centered on the plug 9 when it is inserted into the mold, upper lengths of wood are properly aligned with each other and a stick 20 suitably secured to the upper end of the upper wood piece holds the stack of wood sections properly centered in the mold. A container 2 filled with encapsulating material 8 may be used to fill the mold with encapsulating material.

The encapsulating material may be a plastic having liquid phases above its melting point and solid phases below it. It is liquified for the encapsulating operation and solidified thereafter to form the length of encapsulated wood from which disks are cut. The melting point of such plastic is lower than the charring point for the wood so that the wood may remain in the finished articles. If desired, this wood may be stained to give an attractive appearance to the pieces of jewelry. Where a metal is used as the encapsulating material, the melting point will usually be above this charring temperature so that when it is cast around the wood it chars but retains its identity to impart to the cast metal the pattern of its longitudinal strands. After disks are cut from such an encapsulated length of wood, the wood is removed so that the disk retains the pattern of the wood but has holes where the wood was. If desired, the wood may be removed from the plastic disks by inserting them in a solvent for the wood which does not attack the plastic.

If desired, the center part of a length of wood is removed to make cylinders for bracelets or rings. The center portion may be removed from the pieces of wood before or after encapsulating. If done before, then a core for the mold is necessary to form a cylindrical chamber to hold cylindrical lengths of wood. The core must have a lesser radius than the radial distance between the center and the inner surface of the length of wood so as to encapsulate the wood and provide a layer of encapsulating material around the outer and inner surfaces of the cylindrical section of wood.

FIG. 4 illustrates how the encapsulated material may be cut into the transverse disks 5 by a reciprocating saw blade 6.

The saw cut leaves the surface of the disk rough. Generally speaking, the jewelry of the invention preferably has a smooth surface, and a suitable device for imparting a smooth surface to the disks such as a sanding belt running over pulleys with the upper reach supported by a platform above which the disks are pressed against the moving belt.

After the disk has been smoothed it may be covered with a thin coating of transparent plastic, e.g., by leaving it on the belt and spraying it with the plastic from a suitable container connected by a hose to a source (not shown) of gas under pressure. Alternatively the disks may be placed in shallow molds in a belt, and the plastic may be poured into the molds from a container. Alternatively, the disks may be coated by immersing them in a melt of the plastic in an electrically heated pot and then placing them on a rotating disk for curing and cooling.

The disks 5, as thus treated, may be converted in desired articles of jewelry.

Although the invention has been described and illustrated by reference to specific embodiments, it will be understood by those skilled in the art that many modifications, variations and adaptations may be made in the process disclosed without departing from the spirit of the invention and the scope of the claims.

Having thus described and illustrated the invention, what is claimed is:

1. A process of producing articles of jewelry from the trunk and stems of the chola cactus which comprises; providing a piece of trunk or stem of chola cactus; removing bark and pith from the piece; placing the piece in a mold having an internal diameter greater than the piece's transverse cross section; pouring molten encapsulating material into the mold to encapsulate the piece; allowing the encapsulating material to solidify; then forming disks containing a plurality of cactus pieces from the encapsulated piece.

2. The process of claim 1 further including the step of smoothing the surfaces of at least one disk.

3. The process of claim 1 further including the step of coating at least a disk with plastic.

4. The process of claim 1 further including the steps of smoothing the surfaces of at least one disk and coating the disk with plastic.

5. The process of claim 1 further including providing attachment means to at least one disk.

6. The process of claim 1 further including using a metal as the encapsulating material.

7. The process of claim 1 further including using a plastic as the encapsulating material.

8. The process of claim 1 further including removing at least portions of the cactus pieces from at least one disk.

9. The process of claim 1 wherein the piece of trunk or stem comprises a full transverse cross section of the trunk or stem.

* * * * *